US012291380B2

(12) United States Patent
Arango et al.

(10) Patent No.: US 12,291,380 B2
(45) Date of Patent: May 6, 2025

(54) CONTAINER HAVING OUTER SLEEVE AND INNER SLIDE WITH LOCKING MECHANISM

(71) Applicant: PHILIP MORRIS PRODUCTS S.A., Neuchatel (CH)

(72) Inventors: Juliana Arango, Marin (CH); Julie Polier, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 17/779,650

(22) PCT Filed: Dec. 16, 2020

(86) PCT No.: PCT/EP2020/086396
§ 371 (c)(1),
(2) Date: May 25, 2022

(87) PCT Pub. No.: WO2021/122727
PCT Pub. Date: Jun. 24, 2021

(65) Prior Publication Data

US 2023/0015201 A1 Jan. 19, 2023

(30) Foreign Application Priority Data

Dec. 20, 2019 (EP) ..... 19219110

(51) Int. Cl.
*B65D 5/38* (2006.01)
*B65D 5/42* (2006.01)
*B65D 85/10* (2006.01)

(52) U.S. Cl.
CPC ..... *B65D 5/38* (2013.01); *B65D 5/4266* (2013.01); *B65D 85/1036* (2013.01)

(58) Field of Classification Search
CPC .... B65D 5/38; B65D 5/4266; B65D 85/1036; B65D 2215/02; B65D 5/5007;
(Continued)

(56) References Cited

U.S. PATENT DOCUMENTS 3,302,844 A * 2/1967 Warren ..... B65D 5/38 229/125.125
5,275,291 A 1/1994 Sledge
(Continued)

FOREIGN PATENT DOCUMENTS

CN 109878854 6/2019
EP 3795487 3/2021
(Continued)

OTHER PUBLICATIONS

Extended European Search Report for Application No. 19219110.4 dated Jun. 19, 2020 (7 pages).
(Continued)

*Primary Examiner* — Christopher R Demeree
(74) *Attorney, Agent, or Firm* — Mueting Raasch Group

(57) ABSTRACT

A container (1) for consumer goods, the container comprising: an outer sleeve (20) and an inner slide (50) disposed within the outer sleeve (20), the inner slide (50) at least partially enclosing an interior space for housing consumer goods. The inner slide (50) is slidable with respect to the outer sleeve (20) between: a first position, in which the interior space of the inner slide (50) cannot be accessed by a user; and a second position, in which the interior space of the inner slide (50) can be accessed by a user. When the inner slide (50) is in the first position in the outer sleeve (20), an edge of an inner slide engagement flap (59) is configured to engage with a corresponding engaging element (31) on an
(Continued)

outer sleeve wall, to form a locking mechanism for preventing the inner slide (50) from sliding from the first position to the second position.

15 Claims, 4 Drawing Sheets

(58) Field of Classification Search
CPC .. B65D 5/728; B65D 5/6688; B65D 2215/04; B65D 5/643; A61J 1/16
USPC ..... 229/125.125, 129.1, 125.37; 206/273
See application file for complete search history.

(56) References Cited

U.S. PATENT DOCUMENTS

| | | | | |
|---|---|---|---|---|
| 8,997,979 | B2 | 4/2015 | Ghini et al. | |
| 9,254,938 | B2 * | 2/2016 | Iwata | B65D 85/1054 |
| 10,618,683 | B2 * | 4/2020 | Jones | B65D 5/4266 |
| 2018/0257827 | A1 | 9/2018 | Drosos | |
| 2020/0180808 | A1 * | 6/2020 | Gauvin | B65D 5/38 |
| 2022/0144535 | A1 * | 5/2022 | Fradeani | B65D 85/1054 |

FOREIGN PATENT DOCUMENTS

| | | | | |
|---|---|---|---|---|
| GB | 446782 | | 5/1936 | |
| JP | S40-018392 | | 6/1940 | |
| JP | S51-100236 | U | 8/1976 | |
| JP | S60-148212 | U | 10/1985 | |
| JP | 2009-292513 | | 12/2009 | |
| JP | 2010-126185 | | 6/2010 | |
| JP | 3221584 | U | 5/2019 | |
| KR | 10-2014-0032859 | | 3/2014 | |
| KR | 10-2015-0123514 | | 11/2015 | |
| WO | WO 2009/148032 | | 12/2009 | |
| WO | WO-2009148036 | A1 * | 12/2009 | B65D 85/1054 |
| WO | WO 2016/138305 | | 9/2016 | |
| WO | WO 2021/032621 | | 8/2020 | |
| WO | WO 2021/032619 | | 2/2021 | |
| WO | WO 2021/032622 | | 2/2021 | |
| WO | WO-2021032621 | A1 * | 2/2021 | B65D 5/38 |
| WO | WO 2021/069414 | | 4/2021 | |

OTHER PUBLICATIONS

PCT Search Report and Written Opinion for PCT/EP2020/086396 dated Mar. 8, 2021 (10 pages).
Office Action issued in Japan for Application No. 2022-535834 dated Jan. 29, 2024 (17 pages). English translation included.
Office Action issued in Korean for Application No. 10-2022-7023511 dated Jan. 20, 2025 (15 pages). English translation included.

* cited by examiner

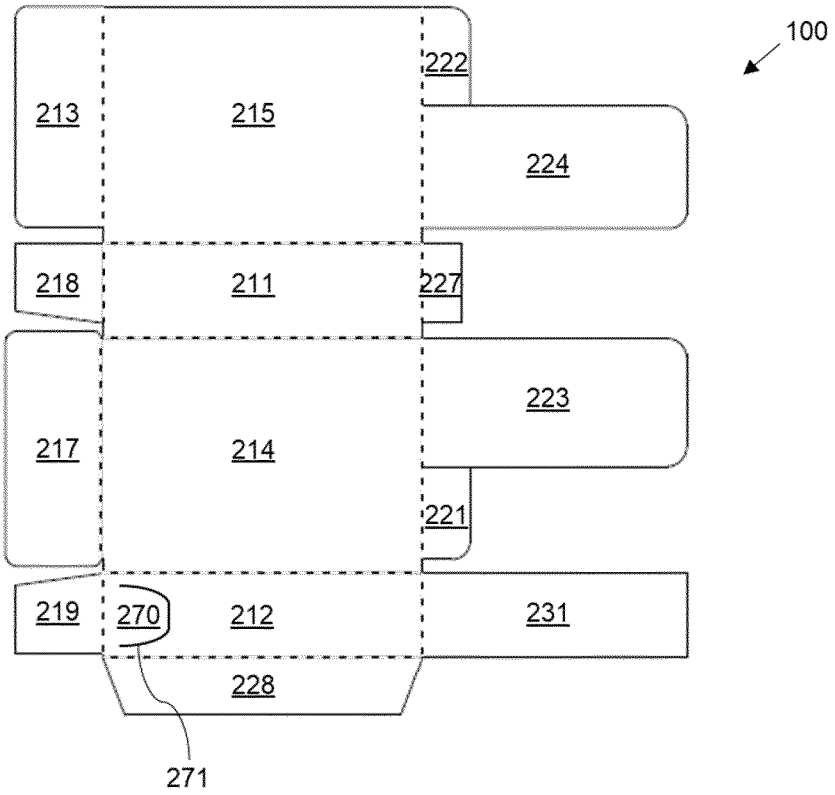
Figure 10
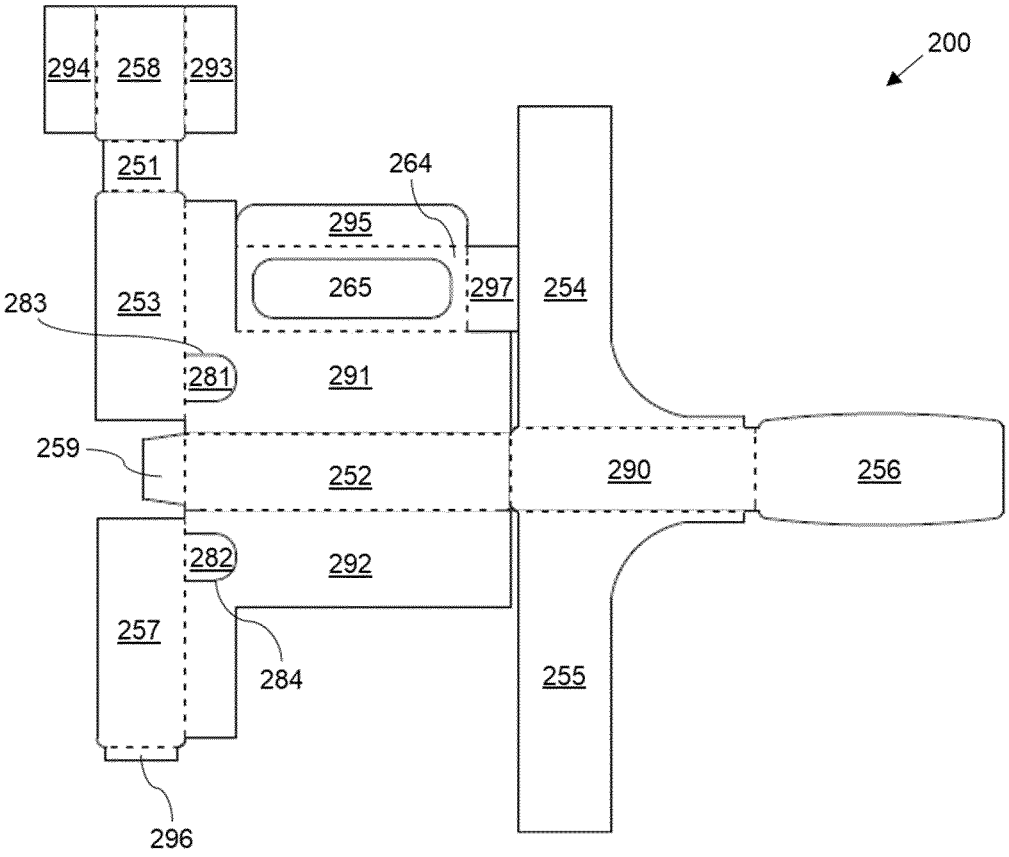

CONTAINER HAVING OUTER SLEEVE AND INNER SLIDE WITH LOCKING MECHANISM

This application is a U.S. National Stage Application of International Application No. PCT/EP2020/086396 filed Dec. 16, 2020, which was published in English on Jun. 24, 2021, as International Publication No. WO 2021/122727 A1. International Application No. PCT/EP2020/086396 claims priority to European Application No. 19219110.4 filed Dec. 20, 2019.

The present invention relates to a container for consumer goods. Containers according to the invention find particular application as containers for aerosol generating articles or components of aerosol generating articles.

It is known to package consumer goods in containers comprising an outer shell or sleeve and an inner slide in which the consumer goods are housed and which is slidable within the outer shell. To remove consumer goods from such containers, a user slides the inner slide from an initial position within the outer shell to an open position in which the inner slide projects outwardly from the outer shell, in order to partially expose an open end or side of the inner slide. Such containers may be referred to as a slide-and-shell container.

It may be desirable to ensure that the inner slide remains enclosed within the outer shell until a user intends to access the consumer goods. For example, it may be desirable to ensure that the inner slide remains in the closed position when the container is being transported. The ensured closure may help to prevent the consumer goods from inadvertently falling out of the container. Preventing an accidental opening of the container may help to preserve one or more properties of the consumer goods, such as their freshness.

It would be desirable to provide a novel and improved container for consumer goods which is configured to reduce the risk of the inner slide inadvertently moving from the closed position to the open position. Further, it would be desirable to provide one or more laminar blanks for forming one such improved container, wherein the manufacturing process is straightforward and cost-effective.

According to the present disclosure, there is provided a container for consumer goods. The container comprises an outer sleeve. The outer sleeve comprises an outer sleeve top wall, an outer sleeve bottom wall, an outer sleeve back wall, first and second opposed outer sleeve side walls, and a first end comprising an opening. The first end of the outer sleeve is delimited by a front edge of each of the outer sleeve top wall, the outer sleeve bottom wall, the outer sleeve back wall, and the first and second opposed outer sleeve side walls. The container comprises an inner slide disposed within the outer sleeve. The inner slide at least partially encloses an interior space for housing consumer goods. The inner slide is slidable with respect to the outer sleeve between: a first position, in which the interior space of the inner slide cannot be accessed by a user; and a second position, in which the interior space of the inner slide can be accessed by a user. Sliding of the inner slide from the first position to the second position involves at least part of the inner slide passing through the opening of the first end of the outer sleeve. The inner slide further comprises an inner slide engagement flap. When the inner slide is in the first position in the outer sleeve, an edge of the inner slide engagement flap is configured to engage with a corresponding engaging element on an outer sleeve wall, to form a locking mechanism for preventing the inner slide from sliding from the first position to the second position.

The inner slide may comprise an inner slide front wall having an inner surface. The inner slide front wall may have a shape and size that is substantially the same as the shape and size of the first end of the outer sleeve. The inner slide front wall may have a shape and size that is the same as the shape and size of the first end of the outer sleeve.

When the inner slide is in the first position in the outer sleeve, a portion of the inner surface of the inner slide front wall may cover the front edge of each of the outer sleeve top wall, the outer sleeve bottom wall, and the first and second opposed outer sleeve side walls. Put another way, when the inner slide is in the first position in the outer sleeve, a portion of the inner surface of the inner slide front wall may overlie the front edge of each of the outer sleeve top wall, the outer sleeve bottom wall, and the first and second opposed outer sleeve side walls. By overlying or covering the front edges of these outer sleeve walls, the inner slide front wall prevents these edges from being visible to a user when the container is viewed from its front.

In some embodiments, the container is configured such that, when the inner slide is in the first position in the outer sleeve, the front edge of each of the outer sleeve top wall, the outer sleeve bottom wall, and the first and second opposed outer sleeve side walls abuts a portion of the inner surface of the inner slide front wall. This may further help to minimise any visible gaps between the walls of the outer sleeve and the inner slide front wall. The portion of the inner surface of the inner slide front wall may be referred to as a peripheral portion.

The inner slide engagement flap and the corresponding engaging element form at least part of a locking mechanism for the container. By providing the container with such a locking mechanism the container can be left in a locked state, in which the interior of the inner slide cannot be accessed. This means that the container can be locked when not in use. The locking mechanism may therefore help to reduce the risk of inadvertent opening of the container. This may help to prevent the consumer goods from inadvertently falling out of the container. This may help to preserve one or more properties of the consumer goods, such as their freshness.

By providing the container according to the present invention, at least part of the locking mechanism may be hidden from the outer appearance of the container. This can mean that the locking mechanism is less visible. This may help to reduce the risk of the container becoming inadvertently unlocked. More specifically, because the inner slide engagement flap is configured to engage with an engaging element on an inner surface of an outer sleeve wall, the inner slide engagement flap can underlie the outer sleeve wall and thus be at least partially hidden.

This may also help for large portions of the outer surface of the container to be substantially uninterrupted and flush. This may be advantageous for one or both of transporting and manufacturing of the container. This may also be advantageous when printing the continuous outer surface of the container.

The choice of using such a locking mechanism in a container having an inner slide, which is slidable relative to an outer sleeve, can be particularly advantageous in reducing the risk of inadvertent opening of the container. This is because the action required to release the locking mechanism, may be a different action from the sliding action required to move the inner slide relative to the outer sleeve. For example, a pressing action may be required to release the locking mechanism, whereas a sliding action may be required to move the inner slide relative to the outer sleeve.

The requirement for such different and distinct actions, can make it even less likely for the container to be opened inadvertently.

Further advantages may arise when arranging for the inner slide front wall to have a shape and size substantially the same as the shape and size of the first end of the outer sleeve, in particular when the shape and size of the inner slide front wall is not greater than the shape and size of the first end of the outer sleeve. For example, in such embodiments, there may be no noticeable portion of the inner slide front wall which extends beyond the perimeter of the first end of the outer sleeve, when the inner slide is in the first position. As such, the inner slide front wall does not have any noticeable pull tabs or portions, which a user may grasp. This can increase the visual effect of the inner slide front wall appearing as though it is an outer sleeve wall, and in particular, an outer sleeve front wall. This may have the advantage of simplifying the appearance of the container. This may also advantageously reduce the likelihood of inadvertent opening of the container, because it makes the inner slide less likely to be inadvertently pulled away from the outer sleeve, when the inner slide is in the first position.

Further advantages may arise when arranging for a portion of the inner surface of the inner slide front wall to cover the front edge of each of the outer sleeve top wall, the outer sleeve bottom wall, and the first and second opposed outer sleeve side walls, when the inner slide is in the first position. For example, with such embodiments, there may be no clear visual indication of which part of the container is formed by the outer sleeve and which part of the container is formed by the inner slide. This is because no noticeable gaps may be visible between the inner slide front wall and the walls of the outer sleeve. Instead, the inner slide front wall may simply appear as though it is an outer sleeve wall, and in particular, an outer sleeve front wall. This may have the advantage of simplifying the appearance of the container. This may also advantageously reduce the likelihood of inadvertent opening of the container, because it makes it harder for the inner slide to be inadvertently pulled away from the outer sleeve, when the inner slide is in the first position. Such an arrangement contrasts with containers where the entire inner slide is completely disposed within the outer sleeve.

In some embodiments, the inner slide front wall may be substantially barrel-shaped. The inner slide front wall may therefore have a substantially straight top edge, a substantially straight bottom edge, and convex outwards first and second side curved edges, each extending from an end point of the substantially straight top edge to an end point of the substantially straight bottom edge. Such an arrangement may be particularly advantageous when the container is formed from a folded cardboard or paperboard laminar blank, and when the side walls of the outer sleeve are major walls of the outer sleeve. This is because in such arrangements the natural material properties of the laminar blank may cause a slight bowing effect in the major side walls of the outer sleeve. This may lead to the first end of the outer sleeve having more of a slight barrel shape, rather than a perfect quadrilateral shape. Consequently, use of a barrel-shaped inner slide front wall in such embodiments may help to ensure that the size and shape of the inner slide front wall more closely equals the size and shape of the first end of the outer sleeve.

As noted above, the inner slide front wall may have a shape and size that is substantially the same as the shape and size of the first end of the outer sleeve. As also noted above, this may advantageously reduce the likelihood of inadvertent opening of the container, because it makes the inner slide less likely to be inadvertently pulled away from the outer sleeve, when the inner slide is in the first position. It will be appreciated that such references to the shape and size of the first end of the outer sleeve refer to the outer sleeve when it is not being subjected to any external force. This may be referred to as a rest state of the outer sleeve. Therefore, when the outer sleeve is in its rest state, the container may be harder to open.

However, if the side walls of the outer sleeve are pressed by a user, they may deflect inwards, and thus reduce the shape and size of the first end of the outer sleeve. In doing so, the side edges of the inner slide front wall may become more exposed and provide gripping points for a user to grip hold of and pull on. Therefore, in order to ease opening of the container, the user may choose to first press on the side walls of the outer sleeve and then pull on the side edges of the inner slide front wall. Such an arrangement is particularly relevant and appreciable in embodiments where the inner slide front wall is substantially barrel-shaped. This is because the outwardly convex first and second side curved edges of the inner slide front wall, will be particularly exposed by the user's action of pressing on the outer sleeve side walls. When the outer sleeve side walls are being pressed by a user, the container may be described as being in a compressed state.

It may be particularly advantageous to arrange for both: the inner slide front wall to have a shape and size substantially the same as the shape and size of the first end of the outer sleeve; and a portion of the inner surface of the inner slide front wall to cover the front edge of each of the outer sleeve top wall, the outer sleeve bottom wall, and the first and second opposed outer sleeve side walls, when the inner slide is in the first position. With such a combination, the visual effect of the inner slide front wall appearing as though it is an outer sleeve wall, and in particular, an outer sleeve front wall, may be enhanced.

Such arrangements may also have an enhanced visual effect when used in a container having the locking mechanism described above. In particular, when the inner slide is in the first position, the locking mechanism can hold the inner surface of the inner slide front wall close to the front edge of each of the outer sleeve top wall, the outer sleeve bottom wall, and the first and second opposed outer sleeve side walls. This can help to minimise any visible gaps between the inner slide front wall and the outer sleeve. This may further enhance the visual effect of the inner slide front wall appearing as though it is an outer sleeve wall, and in particular, an outer sleeve front wall.

The first end of the outer sleeve is delimited by a front edge of each of the outer sleeve top wall, the outer sleeve bottom wall, and the first and second opposed outer sleeve side walls. The front edges of each of the outer sleeve top wall, the outer sleeve bottom wall, and the first and second opposed outer sleeve side walls may therefore collectively define a perimeter of the first end of the outer sleeve.

In some embodiments, the opening of the first end of the outer sleeve extends across the entirety of the first end of the outer sleeve. That is, the opening of the first end of the outer sleeve may be delimited by a front edge of each of the outer sleeve top wall, the outer sleeve bottom wall, and the first and second opposed outer sleeve side walls. In such embodiments, the perimeter of the first end of the outer sleeve may be the same as the perimeter of the opening.

In some embodiments, the first end of the outer sleeve further comprises an outer sleeve front panel extending from the front edge of at least two of the outer sleeve top wall, the outer sleeve bottom wall, and the first and second opposed outer sleeve side walls. In such embodiments, the outer sleeve front panel also forms part of the first end of the outer sleeve together with the opening. In such embodiments, the opening may be at least partially delimited by an edge of the outer sleeve front panel. In such embodiments, the perimeter of the first end of the outer sleeve would not be the same as the perimeter of the opening.

The edge of the inner slide engagement flap, which is configured to engage with a corresponding engaging element on an outer sleeve wall, is preferably a free edge of the inner slide engagement flap. A free edge of a flap is one which does not directly connect the flap to the object from which it depends.

The free edge of the inner slide engagement flap is preferably a leading edge of the inner slide engagement flap. That is, the free edge of the inner slide engagement flap configured to engage with a corresponding engaging element on an outer sleeve wall, is preferably positioned opposite to an edge of the inner slide engagement flap which connects the inner slide engagement flap to the rest of the inner slide.

The inner slide is configured to be slidable with respect to the outer sleeve. The outer sleeve may therefore have an interior configured to receive the inner slide. That is, the outer sleeve may bound a three dimensional space in which the inner slide may reside. The outer sleeve may comprise a second end positioned opposite to the first end of the outer sleeve. The second end of the outer sleeve may comprise an outer sleeve back wall. Therefore, the outer sleeve may have a first end having the opening, and a second end comprising the outer sleeve back wall, with the outer sleeve top wall, outer sleeve bottom wall and first and second opposed outer sleeve side walls extending between the first end of the outer sleeve and the back wall of the outer sleeve.

The inner slide is movable with respect to the outer sleeve between: a first position and a second position. In the first position, the interior space of the inner slide cannot be accessed by a user. In the second position, the interior space of the inner slide can be accessed by a user.

The first position may be regarded as a closed position. The second position may be regarded as an open position. When the inner slide is in the second position, the interior of the inner slide may be directly accessible for a user.

Movement of the inner slide from the first position to the second position involves at least part of the inner slide passing through the opening in the first end of the outer sleeve. In particular, at least part of the inner slide is configured to be slidable through the opening in the first end of the outer sleeve, and thus at least partially move out of the outer sleeve, as the inner slide moves from the first position to the second position. This can help to improve the ease of access to any consumer goods held by the inner slide, when the inner slide is in the second position.

The outer sleeve and the inner slide may be configured so that substantially all of the inner slide is enclosed by the outer sleeve when the inner slide is in the first position. In particular, the outer sleeve and the inner slide may be configured so that all of the inner slide is enclosed by the outer sleeve when the inner slide is in the first position, with the sole exception of the inner slide front wall. The inner slide front wall is instead positioned external to the outer sleeve and covers the front edge of each of the outer sleeve top wall, the outer sleeve bottom wall, and the first and second opposed outer sleeve side walls This can help to minimise the amount of surface area of the inner slide, which can be accessed by a user when the inner slide is in the first position. This may help to minimise inadvertent opening of the container.

The outer sleeve may have an internal height. The internal height of the outer sleeve may be measured as the distance between the inner surface of the outer sleeve top wall and the inner surface of the outer sleeve bottom wall.

The inner slide may comprise an inner slide bottom wall. The inner slide may comprise first and second opposed inner slide side walls. The inner slide may comprise an inner slide back wall. The inner slide may comprise an inner slide top wall. The inner slide top wall may comprise an opening. The opening may enable access to the interior space of the inner slide.

The inner slide may comprise a receptacle portion. The receptacle portion may at least partially enclose the interior space of the inner slide for housing consumer goods.

The receptacle portion may be at least partially defined by the inner slide bottom wall and the first inner slide wall and second inner slide side wall. The receptacle portion may be further defined by the inner slide front wall. The receptacle portion may be further defined by the inner slide back wall. The inner slide may comprise a receptacle portion top wall, and the receptacle portion may be further defined by the receptacle portion top wall. The receptacle portion may be disposed between the inner slide front wall and the inner slide back wall. The receptacle portion top wall may comprise an opening. The opening may enable access to the interior space of the receptacle portion.

Each of the first and second inner slide side walls may have a height in the receptacle portion of the inner slide, which is less than the internal height of the outer sleeve. Put another way, the receptacle portion may have a height, which is less than the internal height of the outer sleeve. This may help to improve access to the receptacle portion and any consumer goods container therein, when the inner slide is in the second position.

The inner slide may comprise a first alignment portion. The first alignment portion may have a height, which is substantially the same as the internal height of the outer sleeve. This can mean that parts of the first alignment portion are always disposed close to the inner surface of the outer sleeve top wall and the inner surface of the outer sleeve bottom wall, when the inner slide is in the outer sleeve. The first alignment portion may therefore be configured to prevent or minimise the inner slide from moving in the outer sleeve in a direction between the outer sleeve top wall and the outer sleeve bottom wall. This may be particularly advantageous when the inner slide engagement flap is configured to overlie the outer surface of the inner slide bottom wall, and the engaging element is disposed on the inner surface of the outer sleeve bottom wall. This is because in such embodiments the first alignment portion can act to ensure that the inner slide engagement flap is positioned close to the engaging element when the inner slide is in the first position. This may help to increase the reliability of engagement between the inner slide engagement flap and the engaging element of the outer sleeve.

The first alignment portion may be formed of one or more of the inner slide back wall, and the first and second inner slide side walls. In some embodiments, the first alignment portion is formed by the inner slide back wall and a rear portion of each of the first and second inner slide side walls. The inner slide back wall may therefore have a height, which is substantially the same as the internal height of the outer sleeve. Alternatively or additionally, a rear portion of each of the first and second inner slide side walls may have a height, which is substantially the same as the internal height of the outer sleeve.

The first alignment portion may also be formed of a top panel extending across the top edges of the inner slide back wall and the rear portions of the first and second inner slide side walls. The top panel of the first alignment portion may help to improve contact between the first alignment portion and the inner surface of the outer sleeve top wall. The top panel of the first alignment portion may help to prevent or minimise pivoting of the inner slide with respect to the outer sleeve, particularly when the inner slide is in the second position.

Where the inner slide comprises the receptacle portion and the first alignment portion, the first alignment portion may be disposed between the outer sleeve back wall and the receptacle portion. The first alignment portion may therefore be disposed towards or at the back of the inner slide.

Where the inner slide comprises the receptacle portion and the first alignment portion, the first alignment portion may comprise a tower structure. The tower structure may extend above the receptacle portion.

The inner slide may comprise a second alignment portion. The second alignment portion may have a height, which is substantially the same as the internal height of the outer sleeve. This can mean that parts of the second alignment portion are always disposed close to the inner surface of the outer sleeve top wall and the inner surface of the outer sleeve bottom wall, when the inner slide is in the outer sleeve. The second alignment portion may therefore be configured to prevent or minimise the inner slide from moving in the outer sleeve in a direction between the outer sleeve top wall and the outer sleeve bottom wall. This may be particularly advantageous when the inner slide engagement flap is configured to overlie the outer surface of the inner slide bottom wall, and the engaging element is disposed on the inner surface of the outer sleeve bottom wall. This is because in such embodiments the second alignment portion can act to ensure that the inner slide engagement flat is positioned close to the engaging element when the inner slide is in the first position. This may help to increase the reliability of engagement between the inner slide engagement flap and the engaging element of the outer sleeve.

The second alignment portion may be formed of one or both of the first and second inner slide side walls. In some embodiments, the second alignment portion is formed by a front portion of each of the first and second inner slide side walls. A front portion of each of the first and second inner slide side walls may therefore have a height, which is substantially the same as the internal height of the outer sleeve.

Where the inner slide comprises the receptacle portion and the second alignment portion, the second alignment portion may be disposed between the inner slide front wall and the receptacle portion. The second alignment portion may therefore be disposed towards or at the front of the inner slide.

The inner slide front wall may be secured to the front edge of each of the first and second inner slide side walls. This may be achieved by one or more adhesives. Alternatively, this may be achieved by forming the inner slide front wall integrally with each of the first and second inner slide side walls.

The front edge of each of the first and second inner slide side walls may have a height, which is at least 50 percent of the height of the inner slide front wall, more preferably at least 60 percent of the height of the inner slide front wall. This may help to minimise bending of the inner slide front wall during use. This can ensure the pack recloses well. This can advantageously help to ensure that the inner slide front wall can maintain its size and shape, and thus maintain its desired visual effect during use of the container.

As noted above, the inner slide may comprise an inner slide back wall, first and second opposed inner slide side walls, and an inner slide bottom wall. In such structural arrangement of the inner slide, preferably, the outer sleeve and the inner slide are configured so that the inner slide back wall, the inner slide bottom wall, and the first and second opposed inner slide side walls are completely underlying their corresponding outer sleeve back wall, outer sleeve bottom wall, and first and second opposed outer sleeve side walls, when the inner slide is in the first position. In such embodiments, at the inner slide back wall, the inner slide bottom wall, and the first and second opposed inner slide side walls will not be visible to a user, when the inner slide is in the first position. This may help to reduce the risk of the container being inadvertently opened. This may also help to enhance the amount of uninterrupted surface area, which is available for communication with the user at one or more of the top, bottom and first and second sides of the container, when the inner slide is in the first position.

When the inner slide comprises an inner slide bottom wall, the inner slide engagement flap may be configured to overlie the inner slide bottom wall. The inner slide engagement flap may extend from the back of the inner slide towards the front of the inner slide, and overlie at least a portion of the outer surface of the inner slide bottom wall. This can advantageously mean that the locking mechanism only engages once the back of the inner slide has reached the back of the outer sleeve. This can help to ensure an efficient use of storage space. When the inner slide is in the first position, the inner slide back wall may be disposed adjacent to an outer sleeve back wall.

In the following description of the invention the terms "side", "top", "bottom", "front", "back" and other terms used to describe relative positions of the components of containers according to the invention. The "bottom" of the container refers to the side of the container opposite the "top" of the container. The "front" of the container refers to the side of the container opposite the "back" of the container.

The term "height" is used herein to refer to dimensions extending between the top and the bottom.

The term "panel" is used herein to refer to a portion of the container formed from a single, continuous portion of material. A panel may depend from one or more other panels.

The term "wall" refers more generally to a facet of the container, and a wall may be formed from a single panel or flap, or a wall may be formed from two or more abutting or overlapping panels or flaps.

The term "depending" is used herein to describe a physical connection between two elements of a container in accordance with the invention. In more detail, the term "depending" is used to indicate that there is a material continuity between two elements, such as two walls or panels of a container or blank. This encompasses both cases wherein a wall or panel depends directly from an adjacent wall or panel as well as cases wherein an intermediate wall or panel effectively connects two walls or panels.

By way of example, a side wall or panel may depend directly from an adjacent front wall or panel. In such case, the wall or panel typically depends along a fold line from the adjacent wall. As an alternative, especially in containers having curved or bevelled edges, a side wall or panel may depend indirectly from a front wall or panel. In such case a curved or bevelled edge wall or panel connects the side wall or panel and the front wall or panel. In the case of a bevelled edge, both side wall or panel and front wall or panel may depend from the connecting bevelled edge wall or panel along respective fold lines. This also applies to optional components of containers in accordance with the invention, for example to a reinforcing member provided in the form of an inner frame.

The term "inner surface" is used throughout the specification to refer to the surface of a component of the assembled container that is facing towards the interior of the container, for example towards the consumer goods, when the container is in the closed position. The term "outer surface" is used throughout the specification to refer to the surface of a component of the container that is facing towards the exterior of the container. For example, the front wall of the package has an inner surface that is facing the inside of the package and the consumer goods, and an outer surface facing away from the consumer goods. It should be noted that the inside or outside surface is not necessarily equivalent to a certain side of a blank used in assembly of the container. Depending on how the blank is folded around the consumer goods, areas that are on the same side of the blank can either face towards the inside or the towards the outside of the container.

The term "fold line" is used to describe any line of a blank about which the blank is folded. The fold line may be defined by a line of weakness to assist with the folding action. Alternatively, a fold can be formed without the presence of a weakening line, depending for example on the pliability of the blank material and other material characteristics.

When the locking mechanism of the container is engaged, the inner slide is prevented from sliding from the first position to the second position with respect to the outer sleeve. Disengagement of the locking mechanism enables the inner slide to slide with respect to the outer sleeve from the first position to the second position. Therefore, the container may be configured so that disengagement of the inner slide engagement flap from its corresponding engaging element on the outer sleeve wall, allows the inner slide to slide with respect to the outer sleeve from the first position to the second position.

The wall of the outer sleeve having the engaging element may be provided with a release element for enabling the edge of the inner slide engagement flap to disengage from the engaging element. The release element may be configured to enable the locking mechanism to transition from a locked state to an unlocked state in response to pressure exerted on the container by a user. In particular, the release element is configured to enable a user to interact with the locking mechanism to cause the locking mechanism to transition into the unlocked state. Preferably, when the inner slide is in the first position, the release element of the outer sleeve overlies at least a portion of the inner slide engagement flap.

In some embodiments, the release element may comprise a cut-out in the wall of the outer sleeve having the engaging element. The cut-out may be positioned adjacent to a portion of the inner slide engagement flap, when the inner slide is in the first position. In such embodiments, the cut-out can allow a user to directly access the inner slide engagement flap and disengage the inner slide engagement flap from the corresponding engaging element on the outer sleeve wall. In particular, a user may insert their finger through the cut-out and push the inner slide engagement flap away from the engaging element on the inner surface of the outer sleeve side wall to unlock the locking mechanism.

In some embodiments, the release element comprises a release tab formed by at least one cut line in the wall of the outer sleeve having the engaging element. For example, an outer sleeve wall may comprise a cut, which defines at least part of the perimeter of a release tab in said wall. The cut may be a U-shaped cut. The cut may be an arcuate cut. The release tab may be deflectable relative to the remainder of its outer sleeve wall. This can allow the release tab to be moved independent of its outer sleeve wall, in response to pressure from a user. The release tab may be positioned adjacent to a portion of its corresponding inner slide engagement flap, when the inner slide is in the first position. Thus, in use, a user can press on the release tab to translate a force to the inner slide engagement flap to disengage the inner slide engagement flap from the engaging element of the outer sleeve wall.

By providing a release element in the form of a release tab, the means for unlocking the locking mechanism can be incorporated into the container with minimal visual impact on the container. The means for unlocking the container may therefore not be obviously visually apparent. This may therefore help to reduce the risk of the container being inadvertently opened.

As noted above, the inner surface of an outer sleeve wall comprises the engaging element for engaging with an edge of each inner slide side flap, when the inner slide is in the first position in the outer sleeve. The engaging element provides a barrier for engaging with the inner slide engagement flap. In particular, the barrier may provide an engagement edge configured to abut the edge of the inner slide engagement flap, when the inner slide is in the first position in the outer sleeve. The engaging element may be integrally formed with its corresponding outer sleeve wall. For example, the outer sleeve wall may be manufactured with a raised portion having an increased thickness to provide the engaging element on the inner surface of the outer sleeve wall. Alternatively, the engaging element may comprise an element affixed to the inner surface of the outer sleeve wall. The element may comprise a strip of material extending across the inner surface of the outer sleeve wall.

The engaging element may be formed from a panel which is secured to part of the inner surface of the outer sleeve wall. The panel may be connected to its corresponding outer sleeve wall by a fold line, and folded about the fold line by about 180 degrees relative to its corresponding outer sleeve wall.

The wall of the outer sleeve having the engaging element may be the outer sleeve bottom wall.

The wall of the outer sleeve having the engaging element may be formed from a first panel and a second panel overlying the first panel. In some embodiments, this wall is the outer sleeve bottom wall. The first panel may define the inner surface of the wall. The second panel may define the outer surface of the wall. The engaging element may therefore be positioned on the first panel, and in particular, on the inner surface of the first panel. The engaging element may be in the form of a panel having an edge configured to abut the engagement flap of the inner slide. This panel may be referred to as an engaging panel. The edge may be provided by an external edge of the engaging panel. Alternatively, the edge may be provided by a cut-out in the engaging panel.

Where the container comprises a release tab, the release tab may be formed on the second panel. In some embodiments, the first panel comprises a cut-out. The cut-out allows the release tab to come into contact with the engagement flap of the inner slide, when the inner slide is in the first position.

The container may further comprise a holding mechanism for preventing the inner slide from entirely sliding out of the opening in the first end of the outer sleeve. The holding mechanism may help to prevent the inner slide from being separated from the outer sleeve. The holding mechanism may prevent the inner slide from being completely removed from the outer sleeve. The holding mechanism may prevent the inner slide from sliding beyond the second position.

The holding mechanism may advantageously provide a user with an indication that the inner slide has reached the second position. More specifically, when the holding mechanism engages to prevent further sliding of the inner slide, the user may be provided with a tactile indication that the inner slide has reached the second position. This may give a user an indication that the inner slide is in a position in which they can access the consumer goods.

In some embodiments, the holding mechanism comprises an extendable member connecting a part of the inner slide to a part of the outer sleeve. The extendable member is configured to change between a retracted state when the inner slide is in the first position, and an extended state when the inner slide is in the second position. The extendable member may be provided in the form of a strip of folded panels, with a first end panel of the strip being secured to a part of the outer sleeve and a second opposing end panel of the strip being secured to a part of the inner slide. For example, the first end panel of the strip may be secured to the inner surface of an outer sleeve wall, such as an outer sleeve bottom wall. The second end panel may be secured to the outer surface of an inner slide wall, such as the inner slide back wall. The extendable member may therefore be concertina-like when it changes between its retracted and extended configurations.

In some embodiments, the holding mechanism comprises a holding element. The holding element may be disposed at the inner surface of an outer sleeve wall. The holding element may be disposed at the inner surface of the outer sleeve wall which comprises the engaging element. The holding element may comprise a holding edge. The holding edge may provide a barrier for engaging with a portion of the inner slide, when the inner slide is in the second position. More specifically, when the inner slide reaches the second position, the holding edge at the inner surface of the outer sleeve wall may engage with a portion of the inner slide to prevent the inner slide from entirely sliding out of the opening in the first end of the outer sleeve.

In some embodiments, the holding element is configured to engage with the inner slide engagement flap to prevent the inner slide from entirely sliding out of the opening of the first end of the outer sleeve.

In some embodiments, the inner slide further comprises an inner slide holding flap. In such embodiments, the holding element is configured to engage with the inner slide holding flap to prevent the inner slide from entirely sliding out of the opening of the first end of the outer sleeve. The inner slide holding flap may depend from the inner slide back wall. The inner slide holding flap may be configured to overlie one of the first and second inner slide side walls, when the inner slide is in the outer sleeve, and in particular, when the inner slide is in the first position.

The holding element may be integrally formed with its corresponding outer sleeve wall. For example, the outer sleeve wall may be manufactured with a raised portion having an increased thickness to provide a holding edge of a holding element on the inner surface of the outer sleeve wall. Alternatively or in addition, the holding element may be affixed to the inner surface of the outer sleeve wall. The holding element may comprise a strip of material extending across part of the inner surface of the outer sleeve wall. The material may be in the form of a panel which is secured to part of the inner surface of the outer sleeve wall.

In some embodiments, the holding element is formed from a panel connected to an outer sleeve wall by a fold line. This panel may be referred to as a holding panel. The holding panel may be folded about the fold line by about 180 degrees relative to its corresponding outer sleeve wall. The fold line may be provided at the first end of the outer sleeve.

In some embodiments, the holding panel depends from a fold line forming an edge of one of the first and second outer sleeve side walls, the edge being disposed proximate to the first end of the outer sleeve opening. In such embodiments, the container may comprise two holding panels, with each holding panel depending from a fold line forming an edge of one of the first and second outer sleeve side walls, respectively. In such embodiments, each holding panel of the outer sleeve may be configured to engage with a corresponding inner slide holding flap when the inner slide reaches the second position to prevent the inner slide from entirely sliding out of the opening of the first end of the outer sleeve.

The holding panel may be folded by about 180 degrees around the fold line and positioned in the inner side of its outer sleeve wall. In some embodiments, the holding panel may project toward the interior of the outer sleeve, and thus toward the inner slide. This is particularly relevant when no adhesive is provided between the holding panel and the outer sleeve wall for fixing the holding panel flush to the inner surface of the outer sleeve wall. This may also be particularly relevant when the holding panel is formed from material having natural resilience, such as cardboard or paperboard. In such embodiments, during sliding of the inner slide from the first position to the second position, a flap of the inner slide may slide into the gap between the holding panel and the outer sleeve wall to prevent the inner slide from sliding entirely out of the opening in the first end of the outer sleeve. The flap of the inner slide may be the inner slide holding flap or the inner side engagement flap.

A holding element having one or more of the above described features can provide a number of advantages. For example, the holding element may be easy to manufacture, particularly if the holding element depends from one of the existing walls of the outer sleeve.

In the container or containers of the present disclosure described above the inner slide is disposed within the outer sleeve. Therefore, such containers are supplied to a user in a fully assembled condition, where the inner slide is disposed within the outer sleeve. However, the present disclosure also contemplates arrangements whereby the inner slide is initially supplied separately from the outer sleeve and a user inserts the inner slide into the interior of the outer sleeve to form the fully assembled container.

According to the present disclosure, there is provided a kit of parts comprising an outer sleeve and an inner slide configured to be received in the outer sleeve to form a container of the present disclosure. The kit of parts may comprise one or more instructions. The instructions may contain instructions for how to insert the inner slide into the outer sleeve to form the fully assembled container. Providing the container in the form of a kit of parts may be advantageous from a manufacturing perspective, because it means that a step of inserting the inner slide into the outer sleeve can be performed by a user.

The present disclosure also concerns one or more laminar blanks for forming at least one of the outer sleeve and inner slide of the container described above. Therefore, according to some embodiments of the present disclosure, there is provided a first laminar blank for forming the outer sleeve. There may also be provided a second laminar blank for forming the inner slide. The outer sleeve may be formed of a single laminar blank. The inner slide may be formed of a separate single laminar blank.

As noted above, containers according to the invention are preferably formed from one or more folded laminar blanks. The one or more laminar blanks may be formed from any suitable material or combination of materials including, but not limited to, cardboard, paperboard, plastic, metal, or combinations thereof. The different components of the container may be formed from the same material, or from different materials. Each of the one or more laminar blanks may be laminar cardboard blank having a weight of between about 100 grams per square metre and about 350 grams per square metre. In preferred embodiments, the blank has a thickness of from about 100 micrometres to about 500 micrometres, preferably from about 200 micrometres to about 350 micrometres.

The container is preferably a rectangular parallelepiped comprising two wider walls (top and bottom) spaced apart by two narrower side walls. Containers according to the invention may be in the shape of a rectangular parallelepiped, with right-angled longitudinal and right-angled transverse edges. The container may comprise one or more rounded longitudinal edges, rounded transverse edges, bevelled longitudinal edges or bevelled transverse edges, or combinations thereof. The shape of the container may be defined by the shape of the outer sleeve.

The container may comprise a plurality of consumer goods. The consumer goods may be aerosol-generating articles. The aerosol-generating articles may be filter cigarettes or other smoking articles in which an aerosol-generating substrate comprises a tobacco material that is combusted to form smoke. The aerosol-generating articles may be articles in which a tobacco material is heated to form an aerosol, rather than combusted. The aerosol-generating articles may be articles in which a nicotine-containing aerosol is generated from a tobacco material, tobacco extract, or other nicotine source, without combustion, and in some cases without heating, for example through a chemical reaction.

The aerosol-generating articles may be provided within the container in the form of a bundle wrapped in an inner package formed of metal foil or metallised paper. The inner package material may be formed as a laminate of a metallised polyethylene film, and a liner material. The liner material may be a super-calendered glassine paper. In addition, the inner package material may be provided with a print-receptive top coating. The inner package has an access opening through which aerosol-generating articles can be removed when the inner slide is in the second position.

Through an appropriate choice of the dimensions, containers according to the invention may be designed to hold different total numbers of aerosol-generating articles, or different arrangements of aerosol-generating articles. For example, through an appropriate choice of the dimensions, containers according to the invention may be designed to hold a total of between ten and thirty aerosol-generating articles. The aerosol-generating articles may be arranged in different collations, depending on the total number.

The invention will now be further described, by way of example only, with reference to the accompanying drawings in which:

FIG. 10 shows a plurality of laminar blanks for forming the container according to the first embodiment of the present invention.

Figure 1:
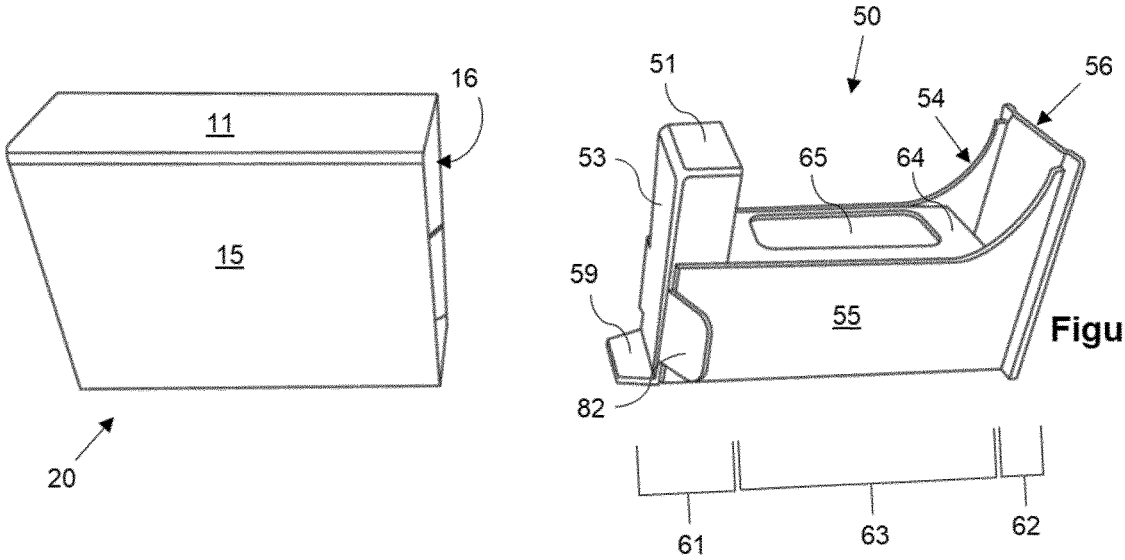
FIG. 1 shows an outer sleeve and an inner slide for forming a container according to the first embodiment of the present invention.

FIG. 1 shows an outer sleeve 20 and an inner slide 50 for forming a container 1 according to the first embodiment of the present invention.

The outer sleeve 20 comprises an outer sleeve top wall 11, an outer sleeve bottom wall 12, an outer sleeve back wall 13, a first outer sleeve side wall (not shown in Figures) , a second outer sleeve side wall 15, and a first end comprising an opening 16. The opening 16 extends across the entirety of the first end of the outer sleeve 20. As best seen from FIG. 4, the opening 16 is delimited by the front edge 111 of the outer sleeve top wall 11, the front edge 121 of the outer sleeve bottom wall 12, the front edge 141 of the first outer sleeve side wall 14, and the front edge 151 of the second outer sleeve side wall 15. Since the opening 16 extends across the entirety of the first end of the outer sleeve 20, the first end of the outer sleeve 20 is also delimited by these front edges 111, 121, 141, 151.

The walls 11, 12, 13, 14 and 15 of the outer sleeve 20 define an enclosure within the outer sleeve 20 for receiving the inner slide 50. The inner slide 50 comprises an inner slide bottom wall 52, a first inner slide side wall 54, a second inner slide side wall 55, an inner slide back wall 53, and an inner slide front wall 56.

The inner slide 50 comprises a receptacle portion 63, which partially encloses an interior space of the inner slide 50 for housing consumer goods. The receptacle portion 63 is defined by the inner slide bottom wall 52, the first and second inner slide side wall walls 54, 55 and a receptacle portion top wall 64. The receptacle portion 63 is disposed between the inner slide front wall 56 and the inner slide back wall 53. The receptacle portion 63 has a height, which is less than the internal height of the outer sleeve 20. The receptacle portion top wall 64 comprises an opening 65, which can enable access to the interior space of the receptacle portion 63.

The inner slide 50 further comprises a first alignment portion 61 comprising a tower structure. The first alignment portion 61 is defined by: the inner slide back wall 53; a rear portion of the inner slide bottom wall 52; rear portions of the first and second inner slide side walls 54, 55; an inner slide top wall 51; and a first alignment portion front wall 58. The first alignment portion 61 has a height, which is substantially the same as the internal height of the outer sleeve 20. This means that when the inner slide 50 is in the outer sleeve 20, parts of the first alignment portion 61 are always disposed close to the inner surface of the outer sleeve top wall 11 and the inner surface of the outer sleeve bottom wall 12.

The inner slide 50 also comprises a second alignment portion 62 having a height, which is substantially the same as the internal height of the outer sleeve 20. The second alignment portion 62 is defined by front portions of the first and second inner slide side walls 54, 55. In these portions, the inner slide side walls 54, 55 extend upwards from the height of the receptacle portion 63 to a position corresponding to the internal height of the outer sleeve 20.

The inner slide 50 further comprises an inner slide engagement flap 59 depending from the back edge of the inner slide bottom wall 52. When the inner slide 50 is disposed in the outer sleeve 20, the inner slide engagement flap 59 is configured to fold underneath the inner slide 50 and overlie the outer surface of the inner slide bottom wall 52. The inner slide 50 also comprises first and second holding flaps 81, 82, each depending from a back edge of a corresponding one of the first and second inner slide side walls 54, 55. When the inner slide 50 is disposed in the outer sleeve 20, each of the first and second holding flaps 81, 82 is configured to overlie the outer surface of its corresponding inner slide side wall 54, 55. The outer sleeve 20 also comprises first and second holding panels 21, 22, each depending from a front edge 141, 151 of a corresponding one of the first and second outer sleeve side walls 14, 15. As best seen from FIG. 4, each of the first and second holding panels 21, 22 is folded about a corresponding front edge 141, 151 of the outer sleeve 20 and projects toward the interior of the outer sleeve 20. As will be described in more detail below, these flaps and panels of the inner slide 50 and outer sleeve 20 cooperate to form a locking mechanism and a holding mechanism for the container 1 of the first embodiment of the present invention.

Figure 2:
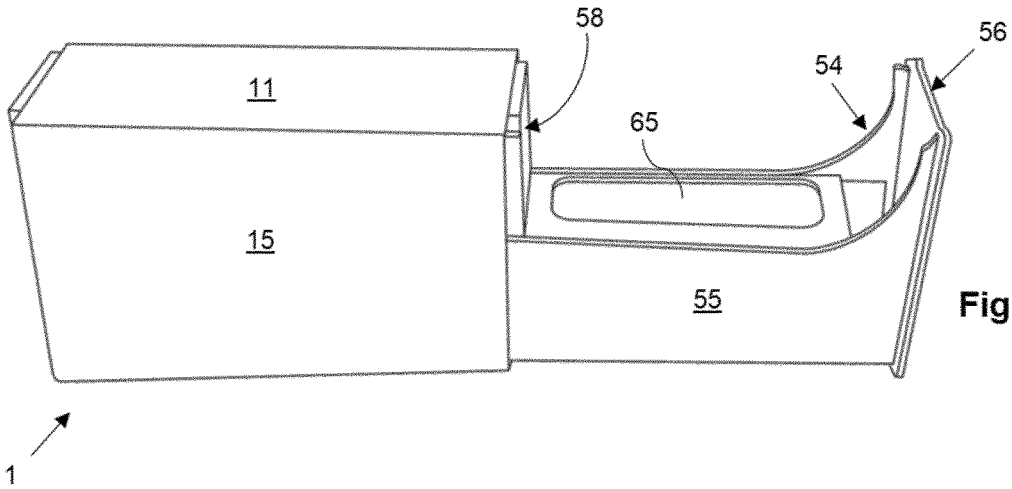
FIG. 2 shows a container according to the first embodiment of the present invention, with the inner slide in a second position.
Figure 3:
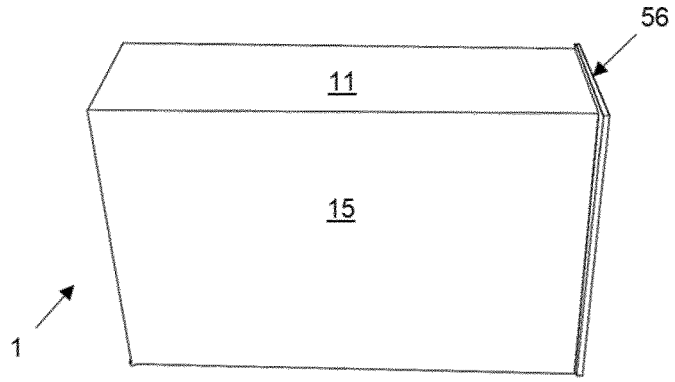
FIG. 3 shows a container according to the first embodiment of the present invention, with the inner slide in a first position.

FIGS. 2 and 3 show the container 1 of the first embodiment of the present invention, with the inner slide 50 in a second position and a first position respectively. In FIG. 2, the inner slide 50 is in the second position, with the receptacle portion 63 disposed external to the outer sleeve 20. In this position, any consumer goods held within the receptacle portion 63 are accessible to a user through the opening 65 in the receptacle portion. When a user no longer wishes to access the consumer goods, the user can slide the inner slide 50 with respect to the outer sleeve 20 such that the receptacle portion 63 moves into the outer sleeve 20. The inner slide 50 can continue to move until it reaches the first positon shown in FIG. 3.

In the first position of FIG. 3, the interior space of the receptacle portion 63 cannot be accessed by a user. Furthermore, in the first position of FIG. 3, a peripheral portion the inner surface of the inner slide front wall 56 covers and abuts the front edge 111, 121,141, 151 of each of the outer sleeve top wall 11, the outer sleeve bottom wall 12, and the first and second opposed outer sleeve side walls 14, 15. Furthermore, the inner slide front wall 56 has a shape and size that is substantially the same as the shape and size of the first end of the outer sleeve 20. This can be seen in FIG. 3 and FIG. 9. Consequently, when the inner slide 50 is in the first position, there is a visual effect of the inner slide front wall 56 appearing as though it is an outer sleeve wall.

Figure 6:
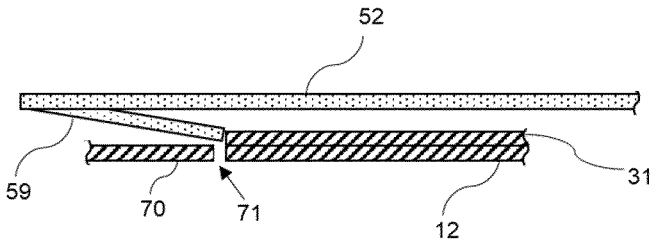
FIGS. 6, 7 and 8 show cross-sectional views of a locking mechanism in different configurations for a container according to the first embodiment of present invention.
Figure 7:
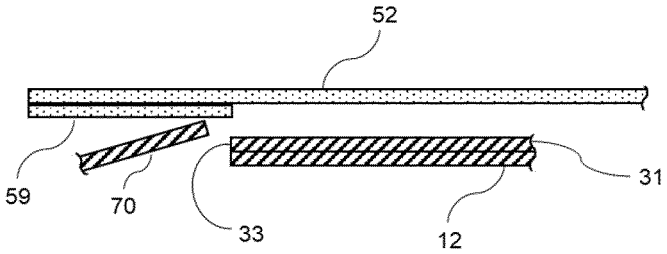
Figure 8:
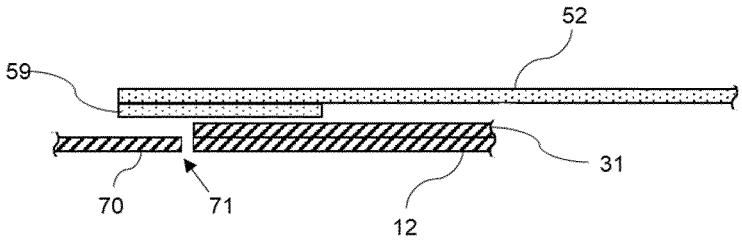

FIGS. 6 to 8 show a partial cross-sectional view of a locking mechanism for a container according to the present invention. The Figures depict the locking mechanism in various configurations.

The locking mechanism comprises an inner slide engagement flap 59 and an outer sleeve engaging element 31. The outer sleeve engaging element 31 is formed by an outer sleeve engaging panel 231 secured to the inner surface of the outer sleeve bottom wall 12. The outer sleeve bottom wall 12 includes an internal cut line 71, which defines a release tab 70 in the outer sleeve bottom wall 12. The release tab 70 is positioned to overlie the inner slide engagement flap 59, when the inner slide is in the first position, as shown in FIG. 6. The inner slide engagement flap 59 depends from the back edge of the inner slide bottom wall 52. When the inner slide 50 is in the outer sleeve 10, the inner slide engagement flap 59 overlies a portion of the outer surface of the inner slide bottom wall 52. When the inner slide 50 is in the outer sleeve 10, the inner slide engagement flap 59 is positioned between the inner slide bottom wall 52 and the outer sleeve bottom wall 12.

The outer sleeve engaging element 31 has an engaging edge 33, which engages with the leading edge of the inner slide engagement flap 59, when the container is in the first position, as shown in FIG. 6, to prevent the inner box 50 from sliding towards and out of the opening 16 in the first end of the outer sleeve 20.

In FIG. 6 the locking mechanism is in a locked state. To unlock the locking mechanism, a user presses on the release tab 70 to cause it to deflect inwards relative to the outer sleeve 20. The release tab 70 then comes into contact with the inner slide engagement flap 59 of the inner slide 50 and pushes the inner slide engagement flap 59 away from the engaging element 31 of the outer sleeve 20. This causes the leading edge of the inner slide engagement flap 59 to disengage from the barrier created by the outer sleeve engaging element 31, as shown in FIG. 7.

FIG. 7 therefore shows the locking mechanism in an unlocked state, with the inner slide 50 still being in the first position relative to the outer sleeve 20. However, because the locking mechanism is now unlocked, the inner slide 50 can now move linearly relative to the outer sleeve 20 and towards a second position in which any consumer goods held in the inner slide 50 can be accessed by a user. Consequently, after pressing on the release tab 70 and unlocking the locking mechanism, a user can slide the inner slide 50 with respect to the outer sleeve 20 to gain access to the consumer goods. Such sliding movement is depicted by the change in position of the inner slide 50 components relative to the outer sleeve 20 components between FIGS. 7 and 8. In particular, the inner slide bottom wall 52 and inner slide engagement flap 59 have been moved laterally in FIG. 8, relative to their position in FIG. 7. FIG. 8 therefore shows the locking mechanism in an unlocked state, with the inner slide 50 being in the second position.

When the user has finished accessing the consumer goods, the user can slide the inner slide 50 back into the interior of the outer sleeve 20. This reverts the inner slide engagement flap 59 to a position corresponding to that shown in FIG. 7. However, as the user is now no longer pressing on the release tab 70, the engagement flap 59 of inner slide 50 can move back to the position shown in FIG. 6 to engage with the outer sleeve engaging element 31. This results in the locking mechanism reverting to the locked state of FIG. 6. The inner slide engagement flap 59 can automatically revert to the position shown in FIG. 6 in such circumstances, because of the biasing force created by the fold line between the inner slide engagement flap 59 and the panel 152 forming the inner slide bottom wall 52.

As noted above, the outer sleeve 20 comprises first and second holding panels 21, 22, which help to form a holding mechanism for preventing the inner slide 50 from sliding beyond a second position. In particular, each of the first and second holding panels 21, 22 is configured to engage with a corresponding one of the first and second holding flaps 81, 82 of the inner slide 50, when the inner slide 50 is in the second position to prevent the inner slide 50 from sliding beyond the second position.

In particular, as the inner slide 50 moves into the second position, the first holding panel 21 of the outer sleeve 20 moves into the space between the first holding flap 81 of the inner slide 50 and the outer surface of the first inner slide side wall 54. Similarly, the first holding flap 81 of the inner slide 50 moves into the space between the first holding panel 21 of the outer sleeve 20 and the inner surface of the first outer sleeve side wall 14. This interlocking arrangement prevents the inner slide 50 from sliding any further beyond the second position. A similar arrangement occurs on the other side of the container 1, in respect of the second holding panel 22 of the outer sleeve 20 and the second holding flap 82 of the inner slide 50.

Figure 4:
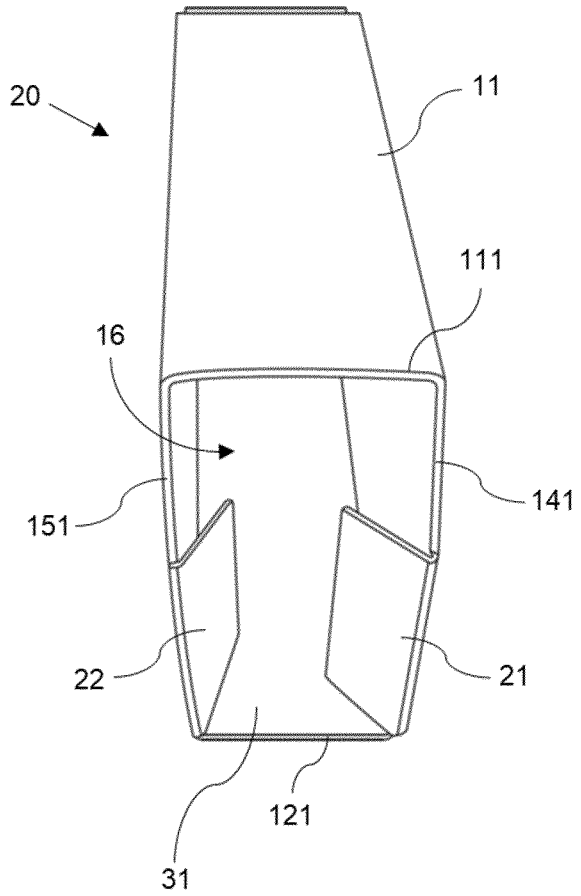
FIG. 4 shows a front perspective view of the outer sleeve of the first embodiment of the present invention.
Figure 5:
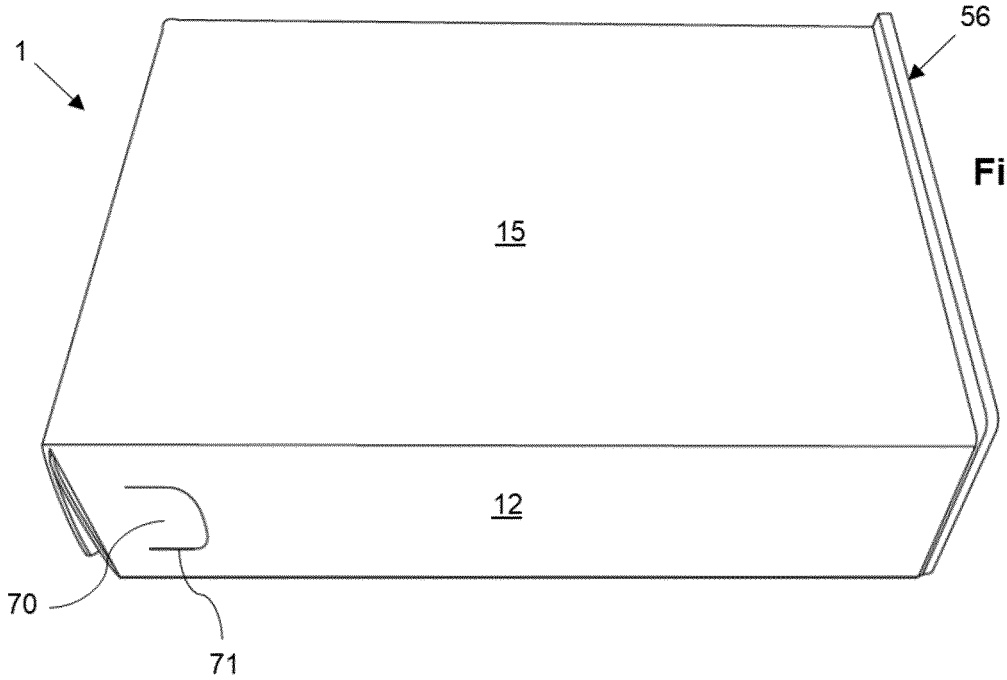
FIG. 5 shows a bottom perspective view of the outer sleeve of the first embodiment of the present invention.

FIG. 10 shows two laminar blanks for forming a container 1 according to the present invention, namely a first laminar blank 100 and a second laminar blank 200. The laminar blanks can be used to form a container 1 as shown in FIGS. 3 and 4. The dashed lines indicate fold lines, and solid lines indicate cut lines in the laminar blanks 100, 200.

The first laminar blank 100 is configured to form the outer sleeve 20. The first laminar blank 100 comprises an outer sleeve top wall panel 211, an outer sleeve bottom wall panel 212, a first outer sleeve back wall panel 213 a second outer sleeve back wall panel 217, a first outer sleeve side wall panel 214, and a second outer sleeve side wall panel 215. These panels together form the walls of the outer sleeve 20.

The first laminar blank 100 further comprises: an outer sleeve top wall reinforcing panel 227 configured to lie against the inner surface of the outer sleeve top wall panel 211; a first outer sleeve side wall reinforcing panel 223 configured to lie against the inner surface of the first outer sleeve side wall panel 214; and a second outer sleeve side wall reinforcing panel 224 configured to lie against the inner surface of the second outer sleeve side wall panel 215. Reinforcing panels 227, 223, 224 may help to provide extra structural rigidity at the first end of the outer sleeve 20. Reinforcing panels 227, 223, 224 may help to improve the appearance of the front edges 111, 121, 141, 151 at the first end of the outer sleeve 20.

The first laminar blank 100 further comprises: a first outer sleeve joining panel 218 configured to join the outer sleeve top wall panel 211 to the second outer sleeve back wall panel 217; a second outer sleeve joining panel 219 configured to join the outer sleeve bottom wall panel 212 to the second outer sleeve back wall panel 217; and a third outer sleeve joining panel 228 configured to join the outer sleeve bottom wall panel 212 to the second outer sleeve side wall panel 215. The joining may be achieved by way of an adhesive in contact with each of the joining panels 218, 219, 228.

The first laminar blank 100 further comprises first and second holding panels 21, 22 (221, 222), each depending from a corresponding one of the first and second outer sleeve side wall panels 214, 215. A u-shaped cut line 271 is provided in the outer sleeve bottom wall panel 212 to define a release tab 270. The first laminar blank 100 further comprises an outer sleeve engaging panel 231 depending from the outer sleeve bottom wall panel 212. When the container is assembled, the outer sleeve engaging panel 231 is secured to the inner surface of the outer sleeve bottom wall 12 (212). To form an outer sleeve engaging element 31.

The second laminar blank 200 comprises: a pair of panels 256, 290 for forming the inner slide front wall 56; a pair of panels 253, 257 for forming the inner slide back wall 53; a pair of panels 254, 291 for forming the first inner slide side wall 54; and a pair of panels 255, 292 for forming the second inner slide side wall 55. In each pair, there is an outer panel 256, 253, 254, 255, which overlaps with a corresponding inner panel 290, 257, 291, 292 to form the wall of the assembled inner slide 50.

The outer panel 256 of the inner slide front wall 56 is substantially barrel-shaped. Furthermore, this outer panel 256 has a greater footprint than its corresponding inner panel 290. Consequently, when the second laminar blank 200 is folded to form the inner slide 50, the shape and size of the inner slide front wall 56 is defined by the shape and size of its outer panel 256.

Figure 9:
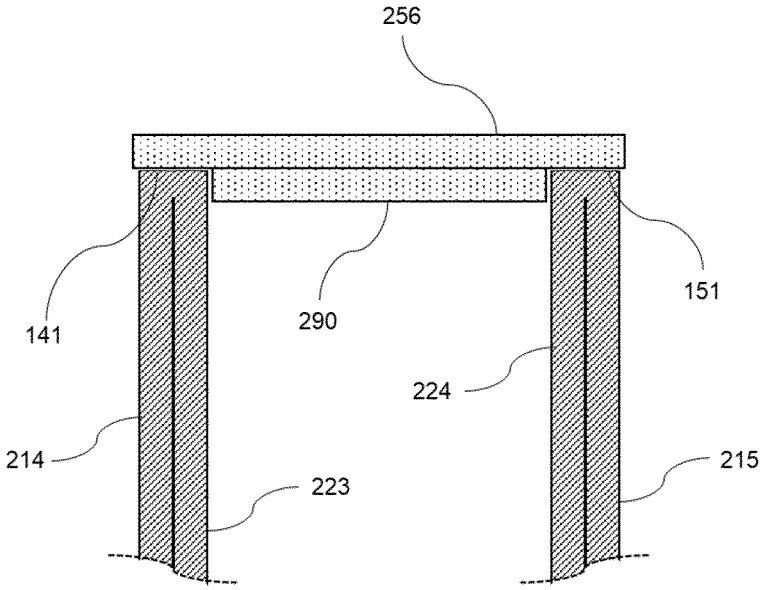
FIG. 9 shows a partial cross-sectional view of the container according to the first embodiment of the present invention, with the inner slide in the first position.

Furthermore, in the assembled inner slide 50, the outer panel 256 of the inner slide front wall 56 extends beyond the inner panel 290 of the inner slide front wall 56, such that the perimeter of the inner slide front wall 56 is defined by the outer panel 256. In addition, as shown in FIG. 9, when the inner slide 50 is in the first position, a peripheral part of the inner surface of the inner slide front wall 56 covers and abuts the front edge 141, 151 of each of the first and second opposed outer sleeve side walls 14, 15. In particular, this inner surface of the inner slide front wall 56 is provided by outer panel 256. The inner panel 290 of the inner slide front wall 56 is positioned within the outer sleeve and between the first and second opposed outer sleeve side walls 14, 15. Consequently, when the inner slide 50 is in the first position, there is a visual effect of the inner slide front wall 56 appearing as though it is an outer sleeve wall.

The second laminar blank 200 also comprises an inner slide bottom wall panel 252 and the inner slide engagement flap 259 depending from the back edge of the inner slide bottom wall panel 252. Further panels in the second laminar blank 200 include a receptacle portion top wall panel 264, an inner slide top wall panel 251, and a first alignment portion front wall panel 258.

The second laminar blank 20 further comprises: a first inner slide joining panel 293 configured to join the first alignment portion front wall panel 258 to the inner panel 292 of the first inner slide side wall 54; a second inner slide joining panel 294 configured to join the first alignment portion front wall panel 258 to the inner panel 291 of the second inner slide side wall 55; and a third inner slide joining panel 295 configured to join the receptacle portion top wall panel 264 to the inner panel 292 of the first inner slide side wall 54. The joining may be achieved by way of an adhesive in contact with each of the joining panels 293, 294, 295.

Each inner panel 291, 292 of the inner slide side walls 54, 55 is provided with a u-shaped internal cut line 283, 284 for forming a holding flap 81, 82 (281, 282) from each panel 291, 292. When the inner slide 50 is assembled, each holding flap 81, 82 (281,281) extends away from its corresponding inner slide side wall 54, 55, as shown in FIG. 1.

The invention claimed is:

1. A container for consumer goods, the container comprising:

an outer sleeve comprising an outer sleeve top wall, an outer sleeve bottom wall, an outer sleeve back wall, first and second opposed outer sleeve side walls, and a first end comprising an opening, the first end being delimited by respective front edges of the outer sleeve top wall, outer sleeve bottom wall, and first and second opposed outer sleeve side walls; and an inner slide disposed within the outer sleeve, the inner slide at least partially enclosing an interior space for housing consumer goods;

wherein the inner slide is slidable with respect to the outer sleeve between:

a first position, in which the interior space of the inner slide cannot be accessed by a user; and a second position, in which the interior space of the inner slide can be accessed by the user, wherein sliding of the inner slide from the first position to the second position involves at least part of the inner slide passing through the opening of the first end of the outer sleeve, wherein, the inner slide further comprises an inner slide engagement flap, wherein, when the inner slide is in the first position in the outer sleeve, an edge of the inner slide engagement flap is configured to engage with a corresponding engaging element on an inner surface of an outer sleeve wall, to form a locking mechanism for preventing the inner slide from sliding from the first position to the second position, wherein the inner slide further comprises an inner slide front wall formed by a panel, the panel having a shape and size that is the same as a shape and size of the first end of the outer sleeve, and wherein, when the inner slide is in the first position in the outer sleeve, a portion of an inner surface of the panel of the inner slide front wall covers a front edge of each of the outer sleeve top wall, the outer sleeve bottom wall, and the first and second opposed outer sleeve side walls.

2. The container according to claim 1, wherein the inner slide front wall is substantially barrel-shaped.

3. The container according to claim 1, wherein the opening of the first end of the outer sleeve extends across the entirety of the first end of the outer sleeve.

4. The container according to claim 1, wherein the inner slide further comprises a receptacle portion at least partially enclosing the interior space for housing consumer goods, the receptacle portion being at least partially defined by an inner slide bottom wall and a first and a second inner slide side walls, and wherein each of the first and second inner slide side walls has a height in the receptacle portion of the inner slide, which is less than an internal height of the outer sleeve.

5. The container according to claim 4, wherein the inner slide further comprises a first alignment portion formed by one or more of an inner slide back wall, and the first and second inner slide side walls, and wherein the first alignment portion has a height, which is substantially the same as the internal height of the outer sleeve.

6. The container according to claim 5, wherein the first alignment portion is disposed between the outer sleeve back wall and the receptacle portion.

7. The container according to claim 1, wherein the inner slide front wall is secured to a front edge of each of a first and a second inner slide side walls, and wherein the front edge of each of the first and second inner slide side walls may have a height, which is at least 50 percent of a height of the inner slide front wall.

8. The container according to claim 1, wherein the container further comprises a holding mechanism for preventing the inner slide from sliding entirely out of the opening in the first end of the outer sleeve.

9. The container according to claim 8, wherein the outer sleeve comprises a holding panel connected to the outer sleeve wall by a fold line, and wherein the holding panel forms part of the holding mechanism.

10. The container according to claim 9, wherein the inner slide further comprises an inner slide holding flap, the inner slide holding flap forming part of the holding mechanism, and wherein during sliding of the inner slide from the first position to the second position, the inner slide holding flap is configured to engage with the holding panel of the outer sleeve to prevent the inner slide from sliding entirely out of the opening in the first end of the outer sleeve.

11. The container according to claim 1, wherein the engaging element of the outer sleeve is provided on an inner surface of the outer sleeve bottom wall.

12. The container according to claim 1, wherein the outer sleeve bottom wall is formed from a first panel and a second panel overlying the first panel, and wherein the engaging element of the outer sleeve is defined by the second panel of the outer sleeve bottom wall.

13. The container according to claim 1, wherein the outer sleeve wall having the engaging element is further provided with a release element for enabling the edge of the inner slide engagement flap to disengage from the engaging element.

14. The container according to claim 13, wherein the release element comprises a release tab formed by at least one cut-line on the outer sleeve wall having the engaging element.

15. The container according to claim 13, wherein the release element overlies at least a portion of the inner slide engagement flap, when the inner slide is in the first position in the outer sleeve.

* * * * *